US012708142B2

(12) United States Patent
Yu et al.

(10) Patent No.: US 12,708,142 B2
(45) Date of Patent: Aug. 18, 2026

(54) HEATER AND SMOKING DEVICE INCLUDING HEATER

(71) Applicant: SHENZHEN FIRST UNION TECHNOLOGY CO., LTD., Shenzhen (CN)

(72) Inventors: Peixia Yu, Shenzhen (CN); Wei Chen, Shenzhen (CN); Wenjuan Li, Shenzhen (CN); Zhongli Xu, Shenzhen (CN); Yonghai Li, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 1120 days.

(21) Appl. No.: 17/825,442

(22) Filed: May 26, 2022

(65) Prior Publication Data

US 2022/0338541 A1 Oct. 27, 2022

Related U.S. Application Data

(63) Continuation of application No. PCT/CN2020/132369, filed on Nov. 27, 2020.

(30) Foreign Application Priority Data

Nov. 27, 2019 (CN) ..... 201911185671.9

(51) Int. Cl.
*A24F 40/46* (2020.01)
*A24F 40/57* (2020.01)

(52) U.S. Cl.
CPC ..... *A24F 40/46* (2020.01); *A24F 40/57* (2020.01)

(58) Field of Classification Search
CPC ..... A24F 40/46; A24F 40/10; A24F 40/20; A24F 40/485; A24F 40/50; A24F 47/00;
(Continued)

(56) References Cited

U.S. PATENT DOCUMENTS

2015/0077981 A1* 3/2015 Cormack ..... A24F 40/70 29/874
2018/0064170 A1 3/2018 Peuchert et al.
(Continued)

FOREIGN PATENT DOCUMENTS

CN 105792686 A 7/2016
CN 206260851 U * 6/2017
(Continued)

*Primary Examiner* — Vy T Nguyen
(74) *Attorney, Agent, or Firm* — IPro, PLLC; Na Xu

(57) ABSTRACT

The present application discloses a heater and a smoking device including the heater. The heater includes: a base having a surface; an infrared electrothermal coating, being disposed on the surface of the base; a conductive module, comprising a first conductive portion and a second conductive portion arranged on the base, both the first conductive portion and the second conductive portion being electrically connected with the infrared electrothermal coating; a flexible printed circuit board, comprising a flexible substrate and a first electrode and a second electrode formed on the flexible substrate; the flexible substrate being fixed on the surface of the base so that the first electrode is electrically connected with the first conductive portion, and the second electrode is electrically connected with the second conductive portion.

8 Claims, 13 Drawing Sheets

(58) Field of Classification Search
CPC ..... A24F 40/40; A24F 40/42; A24F 40/57; A24F 40/65; H05B 1/0291; H05B 1/0297; H05B 2203/003; H05B 2203/021; H05B 3/46; H05B 2203/013; H05B 2203/014; H05B 2203/016; H05B 3/06; H05B 3/08; H05B 3/12; H05B 3/141; H05B 3/145; H05B 3/265; H05B 3/34; H05B 3/40; H05B 3/42; A24B 15/12; A24B 15/16; H01R 13/22; H01R 13/6205; H01R 13/64; H01R 2107/00; H01R 24/38; H01R 24/52
USPC ..... 131/329; 219/553
See application file for complete search history.

(56) References Cited

U.S. PATENT DOCUMENTS

| | | | |
|---|---|---|---|
| 2020/0046028 | A1 | 2/2020 | Oh et al. |
| 2022/0240581 | A1 | 8/2022 | Chen et al. |

FOREIGN PATENT DOCUMENTS

| | | | |
|---|---|---|---|
| CN | 104397878 | A | 10/2017 |
| CN | 109846093 | A | 6/2019 |
| CN | 110384261 | A | 10/2019 |
| CN | 110384264 | A | 10/2019 |
| CN | 211910527 | U | 11/2020 |
| KR | 20180117039 | A | 10/2018 |
| WO | 2019141820 | A | 7/2019 |

* cited by examiner

HEATER AND SMOKING DEVICE INCLUDING HEATER

CROSS-REFERENCE TO RELATED APPLICATION

The present application is based upon and claims priority to Chinese Patent Application No. 201911185671.9, filed with the Chinese Patent Office on Nov. 27, 2019, titled "HEATER AND SMOKING SET COMPRISING THE HEATER", the entire content of which is incorporated herein by reference.

TECHNICAL FIELD

The present application relates to the technical field of smoking devices, and in particular, relates to a heater and a smoking device including heater.

BACKGROUND

Smoking articles such as cigarettes and cigars burn tobacco to produce smoke during use. Attempts have been made to provide substitutes for these tobacco-burning articles by producing products that release compounds without burning. Examples of such products are so-called incombustible products which do not burn when being heated and release compounds by heating instead of burning tobacco.

A smoking device currently available that does not burn when being heated at a low temperature is mainly coated with a far infrared electrothermal coating and a conductive coating on the outside of a base, the conductive coating needs to be connected with a printed circuit board (PCB) or other elements through external wires, and the far infrared electrothermal coating, after being powered on, emits far infrared rays to penetrate the base and heat the aerosol-forming matrix in the base. Because the far infrared rays have strong penetrability, they can penetrate the periphery of the aerosol-forming matrix and enter the aerosol-forming matrix, so that the aerosol-forming matrix can be heated evenly.

SUMMARY

In the first aspect, the embodiment of the present application discloses a heater. The heater includes a base having a surface; an infrared electrothermal coating, being disposed on the surface of the base; the infrared electrothermal coating being configured to generate infrared radiation to heat aerosol-forming matrix to generate aerosol for smoking; a conductive module, comprising a first conductive portion and a second conductive portion arranged on the base, both the first conductive portion and the second conductive portion being electrically connected with the infrared electrothermal coating; a flexible printed circuit board, comprising a flexible substrate and a first electrode and a second electrode formed on the flexible substrate; wherein the flexible substrate is fixed on the surface of the base so that the first electrode is electrically connected with the first conductive portion, and the second electrode is electrically connected with the second conductive portion.

In the second aspect, the embodiment of the present application discloses a smoking device. The smoking device includes a housing assembly and the heater disclosed above; and the heater is arranged in the housing assembly.

BRIEF DESCRIPTION OF THE DRAWINGS

One or more embodiments are illustrated by the pictures in the corresponding drawings, and these illustrative descriptions do not constitute the limitation of the embodiments. Elements with the same reference numerals in the attached drawings represent similar elements, and unless otherwise stated, the figures in the attached drawings do not constitute scale limitation.

DETAILED DESCRIPTION

In order to facilitate the understanding of the present application, the present application will be explained in more detail below with reference to the attached drawings and detailed description. It shall be noted that, when an element is expressed as "fixed to" another element, it may be directly on another element, or there may be one or more intervening elements therebetween. When an element is expressed as "connected" to another element, it may be directly connected to another element, or there may be one or more intervening elements therebetween. The terms "up", "down", "left", "right", "inside", "outside" and similar expressions used in this specification are only for the purpose of illustration.

Unless otherwise defined, all technical and scientific terms used in this specification have the same meanings as commonly understood by those skilled in the art of the present application. In this specification, the terms used in the specification of the present application are only for the purpose of describing specific embodiments, and are not intended to limit the present application. The term "and/or" used in this specification comprises any and all combinations of one or more associated items listed.

Disadvantage of the traditional smoking devices lie in that: on the one hand, the wires externally connected with the conductive coating need to be manually arranged and routed, and the assembly efficiency is low; and on the other hand, in the process of heating, the temperature of the base is relatively high, which is easy to cause the short circuit of sol of the wires and presents a great potential safety hazard.

The present application discloses a heater and the smoking device including the heater whose first electrode and the second electrode are formed on a flexible printed circuit board and electrically connected with a first conductive portion and a second conductive portion arranged on a base. On the one hand, there is no need for wire connection, which avoids the risk of short circuit of sol of the wires; and there is no need for manual wiring, thereby improving the assembly efficiency. On the other hand, the use of flexible printed circuit board saves the space around the base.

First Embodiment

Figure 1:
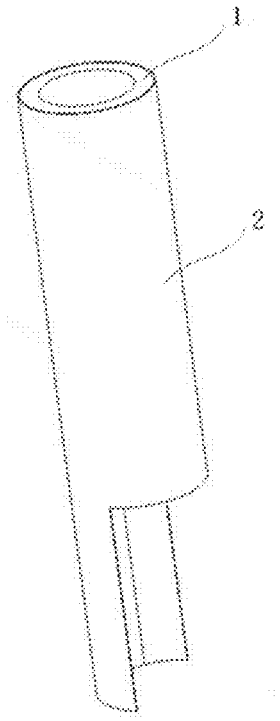
FIG. 1 is a schematic view of a heater according to a first embodiment of the present application.
Figure 2:
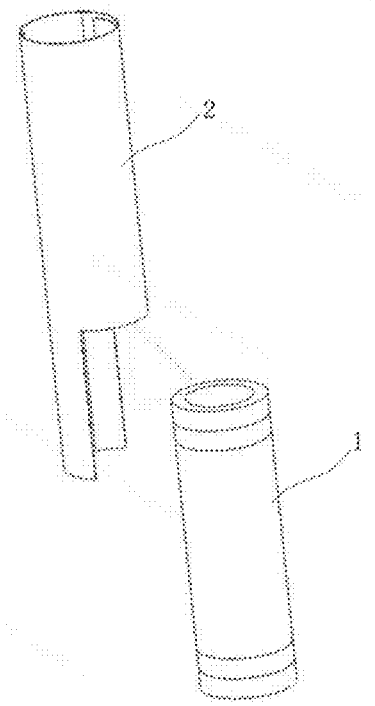
FIG. 2 is an exploded schematic view of FIG. 1.
Figure 3:
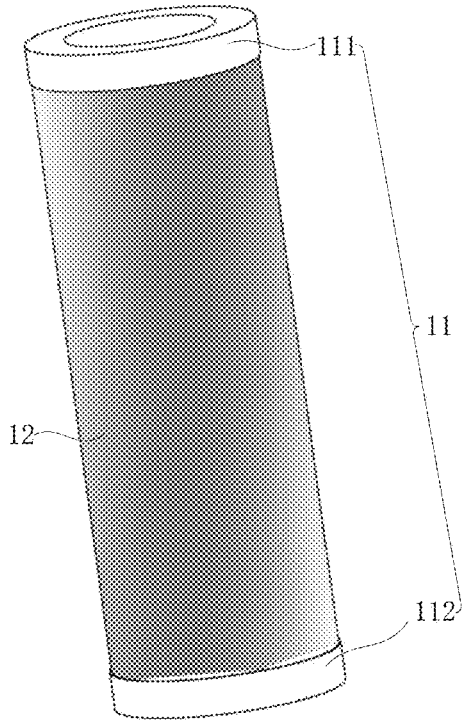
FIG. 3 is a schematic view of a base in the heater according to the first embodiment of the present application.

A heater according to the first embodiment of the present application is as shown in FIG. 1 to FIG. 3. The heater includes a base 1, a conductive module 11, an infrared electrothermal coating 12 and a flexible printed circuit board 2.

The base 1 has a first end and a second end which are opposite to each other, and the base 1 extends in the longitudinal direction between the first end and the second end, and the base 1 is hollow inside with a cavity for containing aerosol-forming matrix formed therein. The base 1 may have shapes of cylinder, prismoid or other columns. In an embodiment, the base 1 is cylindrical, then the cavity is a cylindrical hole penetrating through the middle of the base 1, and the inner diameter of the hole is slightly larger than the outer diameter of aerosol-forming articles or smoking articles, so that the aerosol-forming articles or smoking articles can be easily placed and heated in the cavity.

The base 1 may be made of high-temperature resistant and transparent materials such as quartz glass, ceramics or mica; or the base 1 may be made of other materials with higher infrared transmittance, such as high-temperature resistant materials with infrared transmittance above 95%, and this is not particularly limited in the present application.

The aerosol-forming matrix is a matrix that can release volatile compounds which are capable of forming aerosol. Such volatile compounds may be released by heating the aerosol-forming matrix. The aerosol-forming matrix may be solid or liquid or comprise solid and liquid components. The aerosol-forming matrix may be adsorbed, coated, impregnated or otherwise loaded on a carrier or support. The aerosol-forming matrix may conveniently be part of an aerosol-forming article or a smoking article.

The aerosol-forming matrix may include nicotine. The aerosol-forming matrix may include tobacco, for example, a tobacco-containing material containing volatile compounds with tobacco aroma, and the volatile compounds with tobacco aroma are released from the aerosol-forming matrix when they are heated. An alternative aerosol-forming matrix may comprise a homogeneous tobacco material, such as deciduous tobacco. The aerosol-forming matrix may comprise at least one aerosol-forming agent, and the aerosol-forming agent may be any suitable known compound or mixture of compounds. During use, the compound or mixture of compounds is conducive to the formation of dense and stable aerosol, and is basically resistant to thermal degradation at the operating temperature of the aerosol generating system. Suitable aerosol forming agents are well known in the art and comprise, but not limited to, polyols such as triethylene glycol, 1,3-butanediol and glycerol; esters of polyols, such as glycerin mono-, di- or triacetate; and fatty acid esters of mono-, di- or polycarboxylic acids, such as dimethyl dodecanedioate and dimethyl tetradecanedioate. The alternative aerosol forming agent is polyhydric alcohol or a mixture thereof, such as triethylene glycol, 1,3-butanediol and glycerine.

The infrared electrothermal coating 12 is coated on the surface of the base 1. The infrared electrothermal coating 12 may be coated on the outer surface of the base 1 or the inner surface of the base 1. In an embodiment, the infrared electrothermal coating 12 is coated on the outer surface of the base 1.

The infrared electrothermal coating 12 can generate heat energy when it is powered on, and then generate infrared rays of a certain wavelength, e.g., far infrared rays of 8 μm to 15 μm. When the wavelength of the infrared rays matches the absorption wavelength of the aerosol-forming matrix, the energy of infrared rays is easily absorbed by the aerosol-forming matrix. In an embodiment, the wavelength of the infrared rays is not limited, the infrared rays with the wavelength of 0.75 μm to 1000 μm are possible. Alternatively, the wavelength of far infrared rays can be 1.5 μm to 400 μm.

The infrared electrothermal coating 12 can be made of far infrared electrothermal ink, ceramic powder and inorganic adhesive, which are stirred fully and uniformly and printed on the outer surface of the base 1, and then dried and cured for a certain time. The thickness of the infrared electrothermal coating 12 is 30 μm to 50 μm. Alternatively, the infrared electrothermal coating 12 may also be made of tin tetrachloride, tin oxide, antimony trichloride, titanium tetrachloride and anhydrous copper sulfate, which are mixed and stirred at a certain proportion and then coated on the outer surface of the base 1. Alternatively, the infrared electrothermal coating 12 is one of a silicon carbide ceramic layer, a carbon fiber composite layer, a zirconium titanium oxide ceramic layer, a zirconium titanium nitride ceramic layer, a zirconium titanium boride ceramic layer, a zirconium titanium carbide ceramic layer, an iron oxide ceramic layer, an iron nitride ceramic layer, an iron boride ceramic layer, an iron carbide ceramic layer, a rare earth oxide ceramic layer, a rare earth nitride ceramic layer, a rare earth boride ceramic layer, a rare earth carbide ceramic layer, a nickel cobalt oxide ceramic layer, a nickel cobalt nitride ceramic layer, a nickel cobalt boride ceramic layer, a nickel cobalt carbide ceramic layer or a high-silica zeolite ceramic layer. The infrared electrothermal coating 12 may also be a coating of other materials currently available.

In an embodiment, the heater further includes a protective layer (not shown in the figure) coated on the infrared electrothermal coating 12 and/or a protective structure provided on the infrared electrothermal coating 12. The protective layer may be one of a polytetrafluoroethylene layer and a glaze layer or a combination of the polytetrafluoroethylene layer and the glaze layer, or a protective layer made of other high-temperature resistant materials. The protective structure may be an assembly or component that separates the aerosol-forming article or smoking article from the infrared electrothermal coating 12, and there may be a gap between the protective structure and the infrared electrothermal coating 12 or the aerosol-forming article. The protective layer and/or protective structure can prevent the wear of the infrared electrothermal coating 12 caused by, for example, the movement of the aerosol-forming article (e.g., a cigarette) into or out of the cavity.

The conductive module 11 includes a first conductive portion 111 and a second conductive portion 112 disposed on the base 1. Both the first conductive portion 111 and the second conductive portion 112 are at least partially and electrically connected with the infrared electrothermal coating 12, so that current can flow from one conductive portion to the other conductive portion through the infrared electrothermal coating 12. The polarities of the first conductive portion 111 and the second conductive portion 112 are opposite. For example, the first conductive portion 111 is a positive electrode, and the second conductive portion 112 is a negative electrode. Alternatively, the first conductive portion 111 is a negative electrode, and the second conductive portion 112 is a positive electrode. In an embodiment, the infrared electrothermal coating 12 is coated on the outer surface of the base 1, the first conductive portion 111 is arranged on the outer surface of the base 1 near the first end, and the second conductive portion 112 is arranged on the outer surface of the base 1 near the second end. If the infrared electrothermal coating 12 is coated on the inner surface of the base 1, the conductive module 11 may also be arranged on the inner surface of the base 1 or span the inner and outer surfaces of the base 1.

In this embodiment, both the first conductive portion 111 and the second conductive portion 112 are annular (annular conductive portions). The first conductive portion 111 and the second conductive portion 112 may be annular conductive coatings coated on the outer surface of the base 1 near the first end and the second end. The conductive coatings may be metal coatings or conductive tapes, and the metal coatings may comprise silver, gold, palladium, platinum, copper, nickel, molybdenum, tungsten, niobium or an alloy material of the above metals. The first conductive portion 111 and the second conductive portion 112 may also be annular conductive sheets sleeved on the outer surface of the base 1 near the first end and the second end, and the conductive sheets are metal conductive sheets, such as copper sheets, steel sheets or the like.

Figure 4:
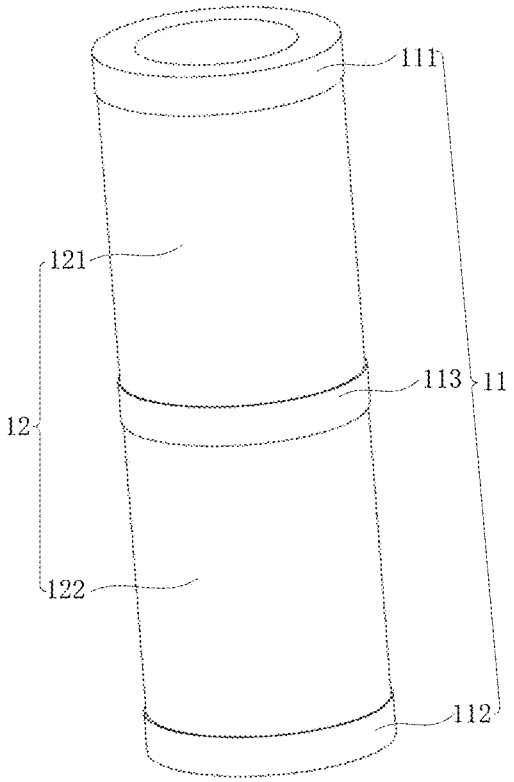
FIG. 4 is a schematic view of another base in the heater according to the first embodiment of the present application.

Referring to FIG. 4, in an embodiment, the conductive module 11 includes a first conductive portion 111, a second conductive portion 112 and a third conductive portion 113. The first conductive portion 111 and the second conductive portion 112 are similar to those shown in FIG. 3, and reference may be made to the above description. The third conductive portion 113 is arranged on the outer surface of the base 1 between the first conductive portion 111 and the second conductive portion 112, and the third conductive portion 113 is electrically connected with the infrared electrothermal coating 12. The third conductive portion 113 divides the infrared electrothermal coating 12 into two heating areas (labeled as 121 and 122 in the figure) along the longitudinal direction of the base 1, thereby the aerosol-forming matrix in the cavity is heated by segmented. In this embodiment, as the infrared electrothermal coating 12 divided into two heating areas by the third conductive portion 113, the segmented heating for the aerosol-forming matrix in the cavity can be realized by controlling the first conductive portion 111, the second conductive portion 112 and the third conductive portion 113 to be turned on or turned off.

Figure 5:
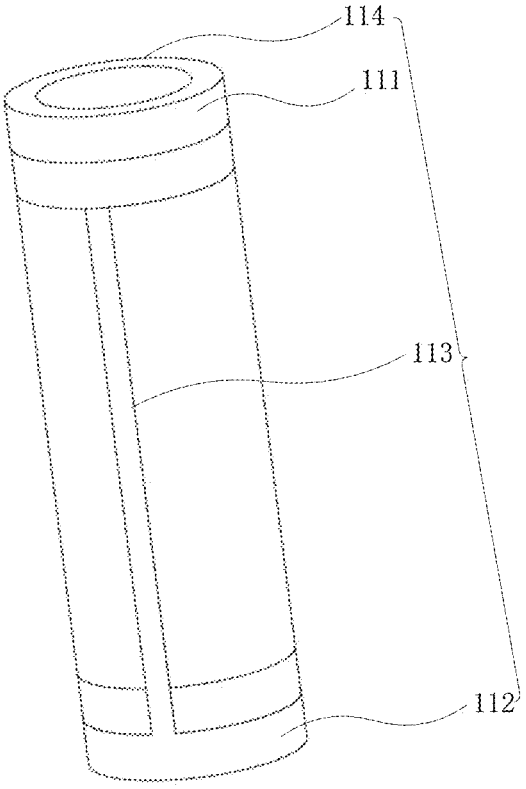
FIG. 5 is a schematic view of another base in the heater according to the first embodiment of the present application.

Referring to FIG. 5, in another embodiment, the conductive module 11 includes a first conductive portion 111, a second conductive portion 112, a third conductive portion 113 and a fourth conductive portion 114. The first conductive portion 111 and the second conductive portion 112 are similar to those in FIG. 3, and reference may be made to the above description. The third conductive portion 113 extends from the second conductive portion 112 along the longitudinal direction of the base 1 (the longitudinal direction toward the first conductive portion 111), and the fourth conductive portion 114 extends from the first conductive portion 111 along the longitudinal direction of the base 1 (the longitudinal direction toward the second conductive portion 112). That is, both the third conductive portion 113 and the fourth conductive portion 114 are elongated conductive portions along the longitudinal direction of the base 1. In this way, as compared to FIG. 3 in which the current flows from the first end to the second end of the base 1 (e.g., flows from the first conductive portion 111 to the second conductive portion 112) along the longitudinal direction of the base 1, the current in this embodiment flows in the circumferential direction of the base 1, thereby shortening the flowing distance of the current in the infrared electrothermal coating 12 and reducing the resistance of the infrared electrothermal coating 12 in the current path.

Figure 6:
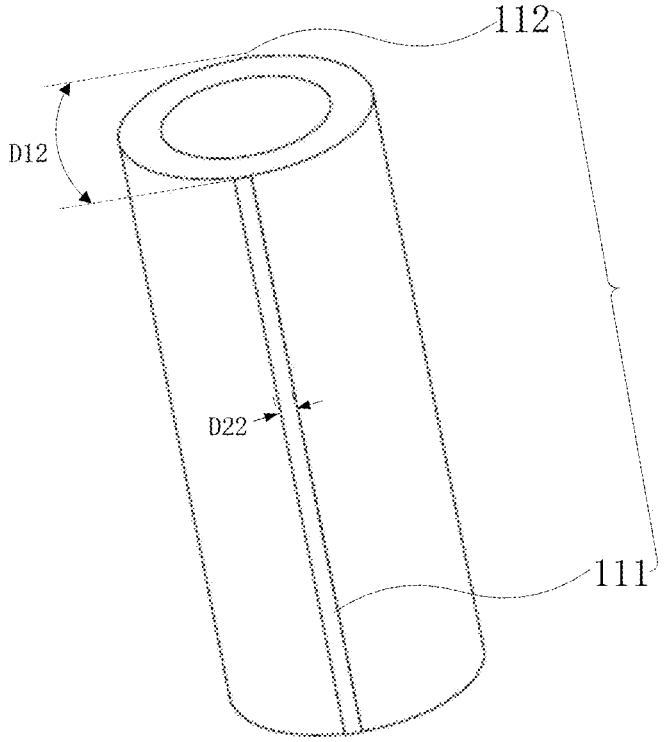
FIG. 6 is a schematic view of yet another base in the heater according to the first embodiment of the present application.

Referring to FIG. 6, in another embodiment, the conductive module 11 includes a first conductive portion 111 and a second conductive portion 112. Different from FIG. 3, both the first conductive portion 111 and the second conductive portion 112 are elongated conductive portions and are arranged along the longitudinal direction of the base 1. As compared to FIG. 3 in which the current flows from the first end to the second end of the base 1 (e.g., flows from the first conductive portion 111 to the second conductive portion 112) along the longitudinal direction of the base 1, the current in this embodiment also flows in the circumferential direction of the base 1, thereby shortening the flowing distance of the current in the infrared electrothermal coating 12 and reducing the resistance of the infrared electrothermal coating 12 in the current path.

Figure 7:
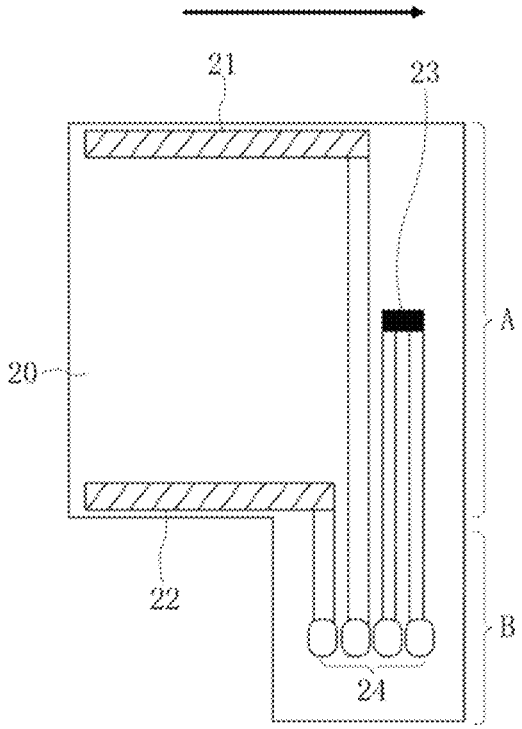
FIG. 7 is a schematic view of a flexible printed circuit board after being unfolded in the heater according to the first embodiment of the present application.

Referring to FIG. 7, the flexible printed circuit board 2 includes a flexible substrate 20, a first electrode 21 and a second electrode 22 formed on the flexible substrate 20, and a temperature acquisition module 23 for acquiring the temperature data of the base 1.

The flexible substrate 20 is fixed on the surface of the base 1, so that the first electrode 21 is electrically connected with the first conductive portion 111, and the second electrode 22 is electrically connected with the second conductive portion 112, and the temperature acquisition module 23 is in contact with or close to a target position on the surface of the base 1. The target position is a preset position suitable for acquiring the temperature data of the base 1, and the preset position may be determined by user experience or experimental test. Generally, the temperature acquisition module 23 is arranged at a position corresponding to area of the infrared electrothermal coating 12. As the temperature acquisition module 23 is integrated in the flexible printed circuit board 2, when the flexible printed circuit board 2 covers the periphery of the base 1, the position of the temperature acquisition module 23 is relatively stable, which ensures the consistency of temperature data acquisition and facilitates the control of the heating temperature of the heater.

The flexible substrate 20 includes a covering part (labeled as A in the figure) covering the surface of the base 1, and an extension part (labeled as B in the figure) not covering the surface of the base 1. The extension part B extends from one end of the covering part A along the longitudinal direction away from the base 1. The extension part B has a plurality of connecting components 24 for connecting with external elements, and the first electrode 21, the second electrode 22 and the temperature acquisition module 23 are respectively connected with the connecting components 24 through conductive lines. The connecting components 24 include, but not limited to, solder joints, welding holes, pads, via holes, wiring terminals and other electrically connected components. The first electrode 21 and the second electrode 22 may be extended to a position away from the base 1 (e.g., the position where the connecting components 24 are located) through the extension part B and the conductive lines.

Figure 12:
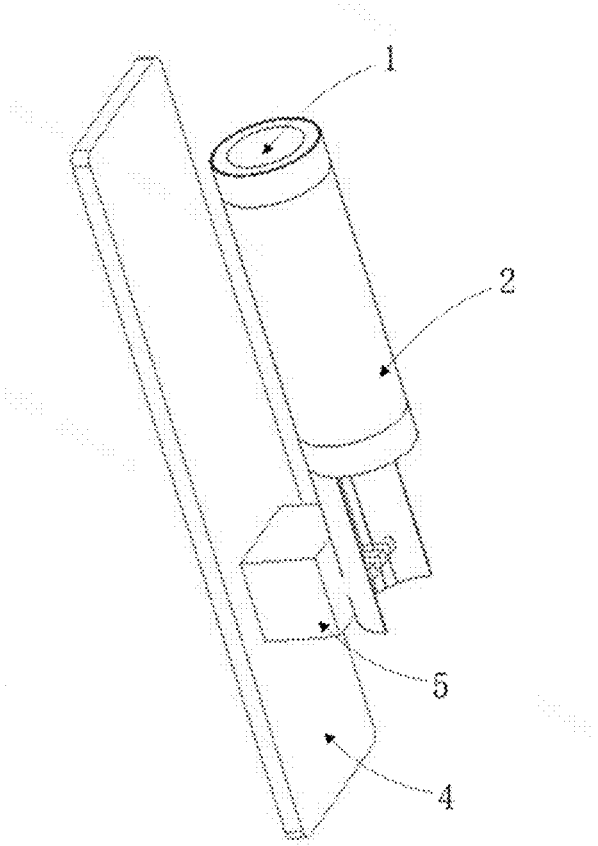
FIG. 12 is a schematic view of the heater and a main control circuit board according to the first embodiment of the present application.

For instance, as shown in FIG. 12, the connecting component 24 is a pad for connecting the main control circuit board 4. The main control circuit board 4 is used to control the heating temperature of the heater and manage the battery of the smoking device. Traditionally, a plurality of wires are adopted to be directly welded with the main control circuit board 4, but such a practice has the following problems. On the one hand, in the process of heating, the temperature of the base is relatively high, which is easy to cause the short circuit of sol of the wires and presents a great potential safety hazard. On the other hand, the number of solder joints is too large, which increases the welding procedures and increases the risk of wrong welding or wrong connection. In this embodiment, the adoption of a patch (or pin) 5, of which one end is welded to the pad on the extension part B and the other end is welded to the main control circuit board 4, can prevent the problems in the traditional practice described below and save the space.

The covering part A, after being curled (covering the surface of the base 1, the curling direction may be as indicated by the arrow in the figure), may be formed into a shape adapted to the outer surface of the cylindrical base 1 and cover the entire outer surface of the base 1. The width of the covering part A in the spreading direction (the direction opposite to the arrow in the figure) is larger than the width of the extension part B in the spreading direction.

It should be noted that in other examples, it is also possible to cover a part of the surface of the base 1, e.g., cover the infrared electrothermal coating 12 between the first conductive portion 111 and the second conductive portion 112, by the covering part A that is curled. Alternatively, it is also possible to cover only the part A by the flexible substrate 20.

In this embodiment, when the flexible substrate 20 covers the surface of the base 1, at least part of the areas of the first electrode 21 and the first conductive portion 111 contact with each other, and at least part of the areas of the second electrode 22 and the second conductive portion 112 contact with each other, thereby ensuring that the first electrode 21 keeps electrical contact with the first conductive portion 111, and the second electrode 22 keeps electrical contact with the second conductive portion 112. The following description is made with reference to FIG. 3 to FIG. 10.

Referring to FIG. 3 and FIG. 7, in this embodiment, the first electrode 21 and the second electrode 22 provided on the flexible substrate 20 are both elongated electrode portions in the transverse direction (referring to the transverse direction of the base 1 or the direction indicated by the arrow in the figure). After the flexible substrate 20 is curled, both the first electrode 21 and the second electrode 22 form into ring-shaped electrodes, which correspond to the annular conductive portions (the first conductive portion 111 and the second conductive portion 112) in FIG. 3, so that when the flexible substrate 20 covers the surface of the base 1, the first electrode 21 keeps in contact with the first conductive portion 111 and the second electrode 22 keeps in contact with the second conductive portion 112.

Figure 8:
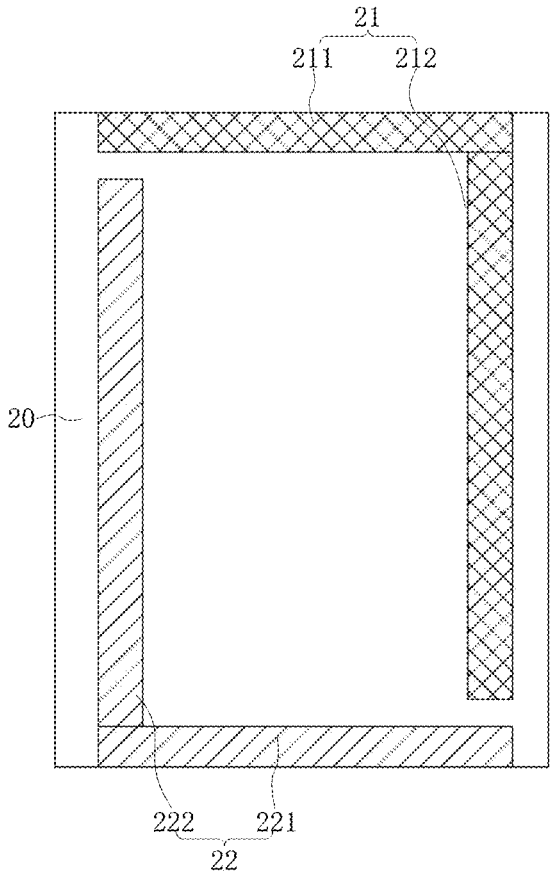
FIG. 8 is a schematic view of another flexible printed circuit board after being unfolded in the heater according to the first embodiment of the present application.

Referring to FIG. 5 and FIG. 8, in an embodiment, the first electrode 21 provided on the flexible substrate 20 includes an elongated electrode portion 211 in the transverse direction and an elongated electrode portion 212 (the elongated electrode portion 212 extends from the elongated electrode portion 211 in the longitudinal direction) in the longitudinal direction (referring to the longitudinal direction of the base 1), and the second electrode 22 includes an elongated electrode portion 221 in the transverse direction and an elongated electrode portion 222 in the longitudinal direction (the elongated electrode portion 222 extends from the elongated electrode portion 221 in the longitudinal direction). After the flexible substrate 20 is curled, the elongated electrode portion 211 and the elongated electrode portion 221 form into ring-shaped electrodes, which correspond to the shape of the annular conductive portions (the first conductive portion 111 and the second conductive portion 112) in FIG. 5. The elongated electrode portion 212 and the elongated electrode portion 222 form an elongated electrode in the longitudinal direction, which corresponds to the shapes of the elongated conductive portions (the third conductive portion 113 and the fourth conductive portion 114) in FIG. 5, so that when the flexible substrate 20 covers the surface of the base 1, the first electrode 21 keeps in contact with the first conductive portion 111 and the second electrode 22 keeps in contact with the second conductive portion 112.

It shall be noted that, for the annular conductive portion and the elongated conductive portion shown in FIG. 8, it is also feasible that the electrodes formed on the flexible substrate 20 only have the elongated electrode portion 211 in the transverse direction and the elongated electrode portion 221 in the transverse direction. Alternatively, it is also feasible that the electrodes formed on the flexible substrate 20 only have the elongated electrode portion 212 in the longitudinal direction and the elongated electrode portion 222 in the longitudinal direction.

Figure 9:
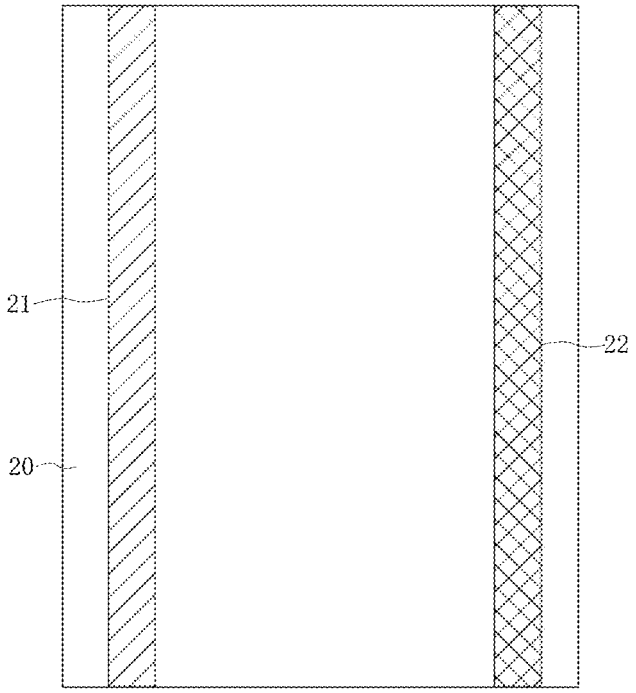
FIG. 9 is a schematic view of another flexible printed circuit board after being unfolded in the heater according to the first embodiment of the present application.

Referring to FIG. 6 and FIG. 9, in an embodiment, the first electrode 21 and the second electrode 22 provided on the flexible substrate 20 are both elongated electrode portions in the longitudinal direction. After the flexible substrate 20 is curled, both the first electrode 21 and the second electrode 22 form into elongated electrodes in the longitudinal direction, which correspond to the shapes of the elongated conductive portions (the first conductive portion 111 and the second conductive portion 112) in FIG. 6, so that when the flexible substrate 20 covers the surface of the base 1, the first electrode 21 keeps in contact with the first conductive portion 111 and the second electrode 22 keeps in contact with the second conductive portion 112.

Figure 10:
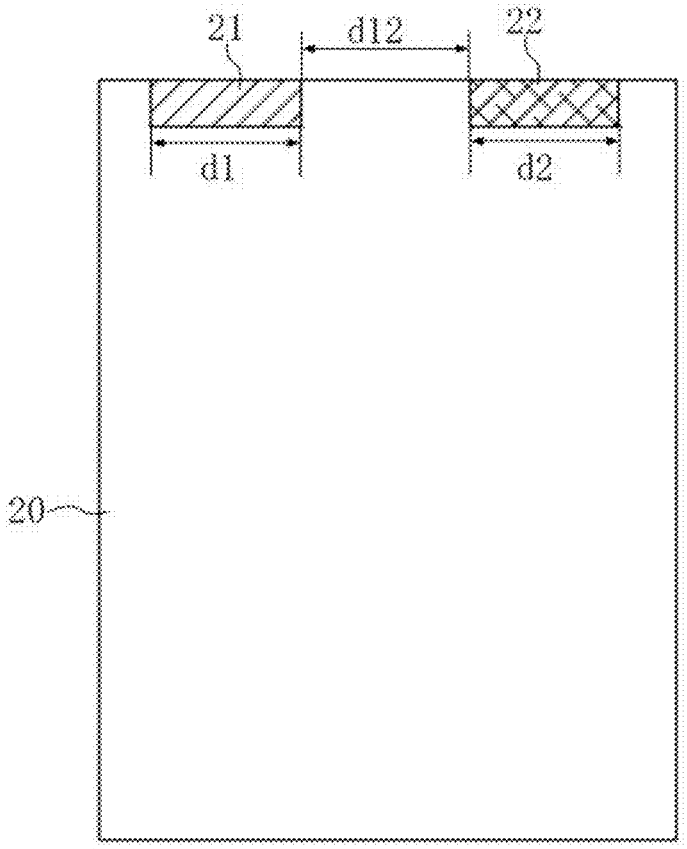
FIG. 10 is a schematic view of yet another flexible printed circuit board after being unfolded in the heater according to the first embodiment of the present application.

Referring to FIGS. 6 and 10, in an embodiment, the first electrode 21 and the second electrode 22 provided on the flexible substrate 20 are both elongated electrode portions in the transverse direction. After the flexible substrate 20 is curled, the first electrode 21 and the second electrode 22 form into two arc-shaped electrodes at one end of the base 1. The arc-shaped electrodes correspond to the elongated conductive portions (the first conductive portion 111 and the second conductive portion 112) in FIG. 6, so that when the flexible substrate 20 covers the surface of the base 1, the first electrode 21 keeps in contact with the first conductive portion 111 and the second electrode 22 keeps in contact with the second conductive portion 112. It shall be noted that, it is also feasible if both the first conductive portion 111 and the second conductive portion 112 are elongated conductive portions extending from one end to the other end of the base 1 (generally in the form of spiral on the surface of the base 1).

In this embodiment, both the first electrode 21 and the second electrode 22 are provided at one end of the flexible substrate 20. After the flexible substrate 20 is curled, the lengths of the two arc-shaped electrodes formed by the first electrode 21 and the second electrode 22 at one end of the base 1 are both smaller than the circumferential distance between the elongated conductive portions, e.g., d1 and d2 in FIG. 10 are smaller than D12 in FIG. 6. The intervals between two arc-shaped electrodes are all larger than the circumferential widths of the elongated conductive portions, e.g., d12 in FIG. 10 is larger than D22 in FIG. 6.

It shall be noted that, in other embodiments, it is also feasible that the first electrode 21 and the second electrode 22 are respectively formed at two ends, the middle or other positions on the flexible substrate 20.

In an embodiment (not shown in the figure), both the first electrode 21 and the second electrode 22 are elongated electrode portions (approximately in the form of oblique lines, curved lines or other forms on the flexible substrate 2) extending from one end of the flexible substrate 2 to the other end. Both the first conductive portion 111 and the second conductive portion 112 are elongated conductive portions extending from one end to the other end of the base 1 (approximately in the form of spiral on the surface of the base 1).

After the flexible substrate 20 is curled, the electrodes formed by the first electrode 21 and the second electrode 22 (which can be electrodes in the form of oblique lines, curved lines and spiral, etc.) correspond to the elongated conductive portions (the first conductive portion 111 and the second conductive portion 112), so that when the flexible substrate 20 covers the surface of the base 1, the first electrode 21 keeps in contact with the first conductive portion 111 and the second electrode 22 keeps in contact with the second conductive portion 112.

Referring to FIG. 4 for appreciation, in one example, the flexible printed circuit board 2 includes a flexible substrate 20, and a first electrode 21, a second electrode 22 and a third electrode (not shown in the figure) formed on the flexible substrate 20. Reference may be made to the above examples for the shape of the third electrode.

When the flexible substrate 20 covers the surface of the base 1, the first electrode 21 is electrically connected to the first conductive portion 111, the second electrode 22 is electrically connected to the second conductive portion 112, and the third electrode is electrically connected to the third conductive portion 113.

In this embodiment, in order to ensure the heating effect of the heater, a larger current is required to pass through the first electrode 21 and the second electrode 22, so the line widths of the first electrode 21 and the second electrode 22 may be set to be 0.2 mm to 3 mm. In an embodiment, the line widths of the first electrode 21 and the second electrode 22 are set to be 0.2 mm to 1 mm.

Figure 11:
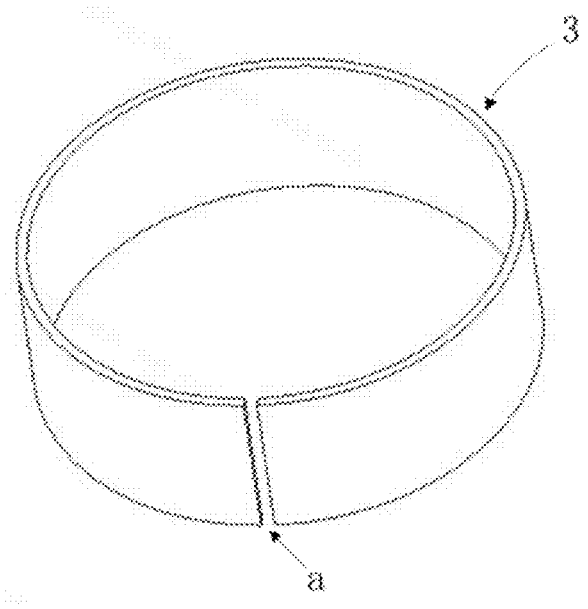
FIG. 11 is a schematic view of a fixing ring in the heater according to the first embodiment of the present application.

Referring to FIG. 11, in an embodiment, in order to achieve stronger fixation between the first electrode 21 and the first conductive portion 111 as well as between the second electrode 22 and the second conductive portion 112, and ensure the electrical connection between the electrodes and the conductive portions, the heater further includes a first fixing member and a second fixing member (a structure labeled as 3 in FIG. 11). The first fixing member fixes the first electrode 21 on the first conductive portion 111, and the second fixing member fixes the second electrode 22 on the second conductive portion 112.

In this embodiment, both the first fixing member and the second fixing member are fixing rings with broken notches (labeled as "a" in the figure), and the inner diameter of the fixing rings is smaller than the outer diameter of the base 1. The small inner diameter and the broken notch ensure that the fixing ring is sleeved on the base 1 with a certain amount of interference, and ensure that the electrode is closely attached to the conductive portion while maintaining a certain degree of elasticity.

Figure 13:
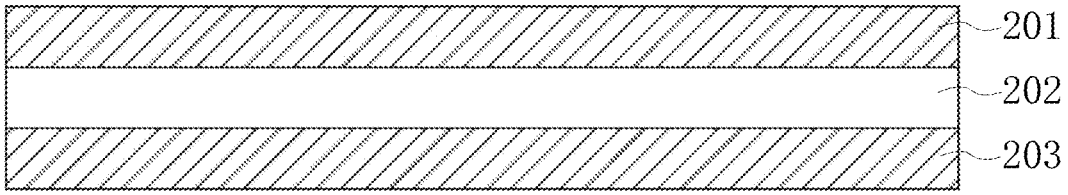
FIG. 13 is a schematic view of a flexible substrate in the heater according to the first embodiment of the present application.

Referring to FIG. 13, in an embodiment, the flexible substrate 20 is a polyimide thin film, which includes a first polyimide layer 201, a second polyimide layer 203 and a circuit layer 202, wherein at least a part of the circuit layer 202 is positioned between the first polyimide layer 201 and the second polyimide layer 203.

In this embodiment, the temperature acquisition module 23 may be a conductive material with a temperature coefficient of resistance, and the conductive material is disposed on the circuit layer 202.

In an embodiment, the heater further includes a hollow heat insulation pipe.

The heat insulation pipe covers the periphery of the flexible printed circuit board 2. The heat insulation pipe can prevent a large amount of heat from being transferred to the shell of the smoking device, which otherwise would make the user feel hot.

In this embodiment, since a phenomenon that heat is diffused by conduction or convection exists for the infrared electrothermal coating 12, the inner surface of the heat insulation pipe may further be coated with a reflective coating to reflect the infrared rays emitted by the infrared electrothermal coating 12 on the base 1 back to the interior of the base 1 to heat the aerosol-forming matrix in the cavity, thereby improving the heating efficiency. On the other hand, the effect of heat insulation can be achieved to prevent the shell of the smoking device from having an excessively high temperature, which otherwise would reduce the user experience.

In this embodiment, the reflective coating includes at least one of metal and metal oxide. Specifically, the reflective coating may be made of one or more of gold, silver, nickel, aluminum, gold alloy, silver alloy, nickel alloy, aluminum alloy, gold oxide, silver oxide, nickel oxide and aluminum oxide, titanium oxide, zinc oxide and cerium dioxide. The thickness of the reflective coating ranges from 0.3 μm to 200 μm.

In this embodiment, the heat insulation pipe includes heat insulation material, which may be heat insulation glue, aerogel, aerogel felt, asbestos, aluminum silicate, calcium silicate, diatomaceous earth, zirconia or the like. Alternatively, the heat insulation pipe may also include a vacuum heat insulation pipe.

Second Embodiment

Figure 14:
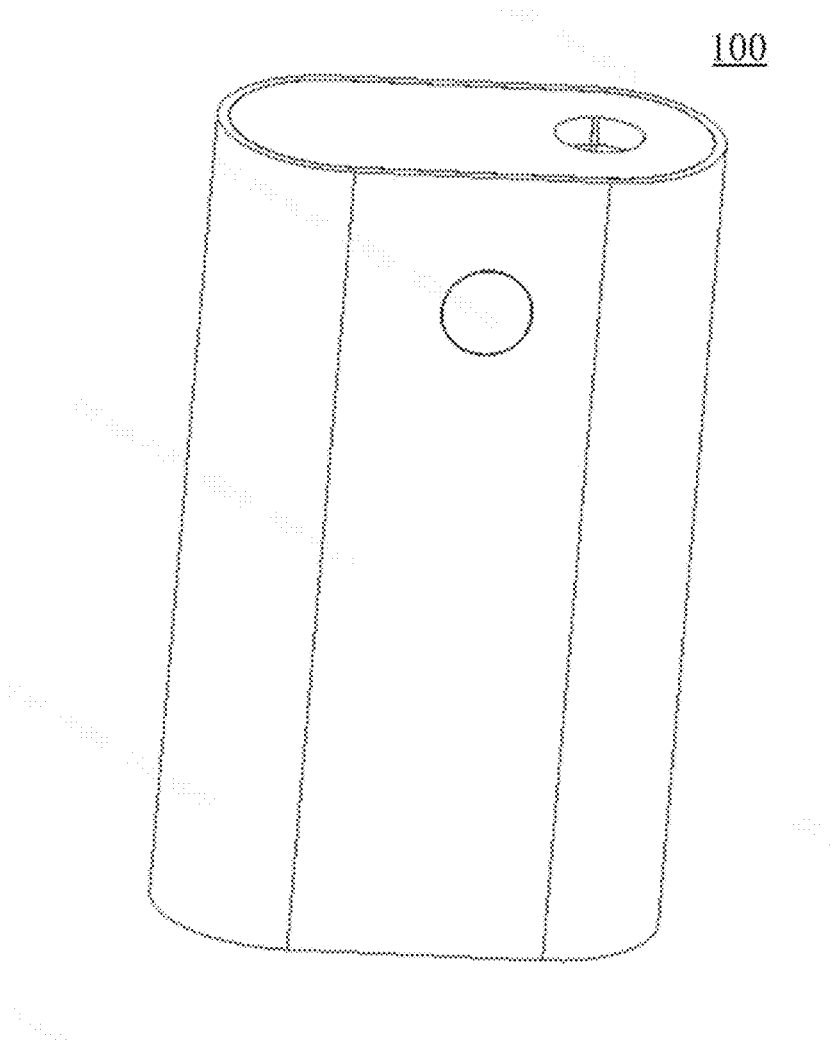
FIG. 14 is a schematic view of a smoking device according to a second embodiment of the present application.
Figure 15:
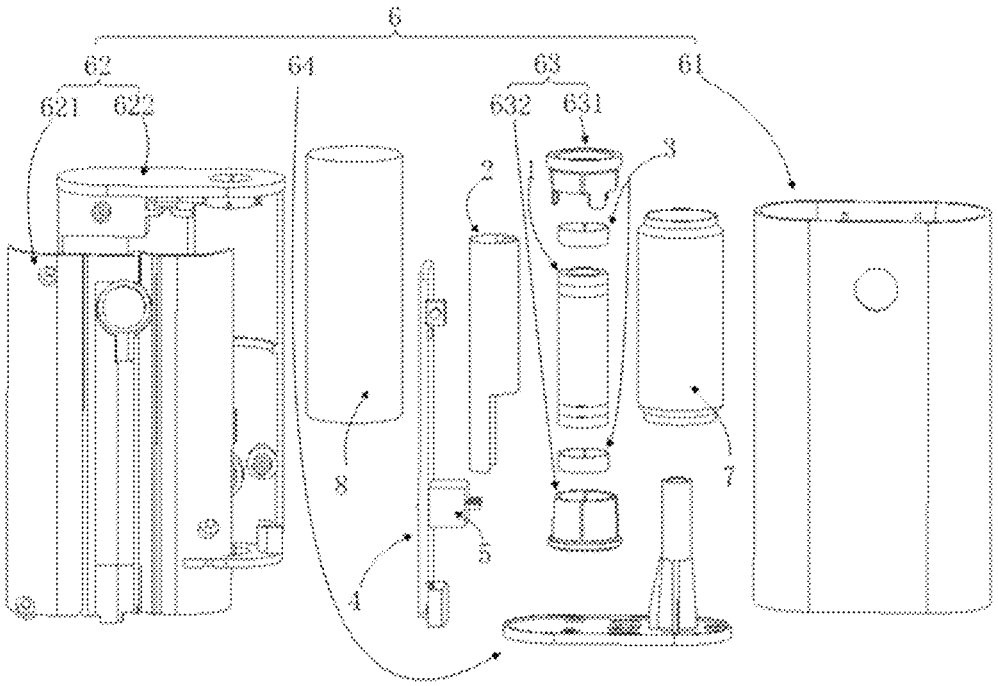
FIG. 15 is an exploded schematic view of FIG. 14.

FIG. 14 to FIG. 15 show a smoking device 100 according to the second embodiment of the present application, the smoking device 100 includes a housing assembly 6 and the above-mentioned heater, and the heater is arranged within the housing assembly 6. In the smoking device 100 according to the second embodiment, the outer surface of a base 1 is provided with an infrared electrothermal coating 12 and a first conductive portion 111 and a second conductive portion 112 electrically connected with the infrared electrothermal coating 12. The infrared electrothermal coating 12 may emit infrared rays for radiation heating of the aerosol-forming matrix in the cavity of the base 1.

The housing assembly 6 includes a shell 61, a fixing housing 62, a fixing member 63 and a bottom cover 64, and the fixing housing 62 and the fixing member 63 are both fixed in the shell 61. The fixing member 63 is used for fixing the base 1 and is arranged in the fixing housing 62, and the bottom cover 64 is arranged at one end of the shell 61 and covers the shell 61. Specifically, the fixing member 63 includes an upper fixing seat 631 and a lower fixing seat 632, both of which are arranged in the fixing housing 62. The first end and the second end of the base 1 are respectively fixed on the upper fixing seat 631 and the lower fixing seat 632, the bottom cover 64 is convexly provided with an air inlet pipe, and an end of the lower fixing seat 632 facing away from the upper fixing seat 631 is connected with the air inlet pipe. The upper fixing seat 631, the base 1, the lower fixing seat 632 and the air inlet pipe are coaxially arranged, and the base 1 is sealed with the upper fixing seat 631 and the lower fixing seat 632, the lower fixing seat 632 is further sealed with the air inlet pipe, and the air inlet pipe communicates with the air outside so as to facilitate smooth air intake when the user sucks.

The smoking device 100 further includes a flexible printed circuit board 2, fixing rings 3, a main control circuit board 4, a patch 5 and a battery 8. The two fixing rings 3 are respectively sleeved on the first end and the second end of the base 1, and the flexible printed circuit board 2 covers the periphery of the base 1. One end of the patch 5 is welded to the connecting component 24 (pad) of the flexible printed circuit board 2, and the other end thereof is welded to the main control circuit board 4. The fixing housing 62 includes a front housing 621 and a rear housing 622, the front housing 621 is fixedly connected with the rear housing 622, the main control circuit board 4 and the battery 8 are both arranged in the fixing housing 62, the battery 8 is electrically connected with the main control circuit board 4, and the flexible printed circuit board 2 is also electrically connected with the main control circuit board 4. A key is convexly arranged on the shell 61, and the infrared electrothermal coating 12 on the outer surface of the base 1 may be turned on or turn off by pressing the key. The main control circuit board 4 is further connected with a charging interface, and the charging interface is exposed on the bottom cover 64. Users can charge or upgrade the smoking device 100 through the charging interface to ensure the continuous use of the smoking device 100.

The smoking device 100 further includes a heat insulation pipe 7, which is arranged in the fixing housing 62 and sleeved outside the base 1. The heat insulation pipe 7 can prevent a large amount of heat from being transferred to the shell 61, which otherwise would make the user feel hot. Specifically, a reflective coating may further be coated inside the heat insulation pipe 7, so as to reflect the infrared rays emitted by the infrared electrothermal coating 12 on the base 1 back to the interior of the base 1 to heat the aerosol-forming matrix in the cavity, thereby improving the heating efficiency.

The flexible printed circuit board 2 is integrated with a NTC temperature sensor for detecting the real-time temperature of the base 1 and transmitting the detected real-time temperature to the main control circuit board 4, and the main control circuit board 4 adjusts the magnitude of the current flowing through the infrared electrothermal coating 12 according to the real-time temperature. Specifically, when it is detected by the NTC temperature sensor that the real-time temperature inside the base 1 is low, e.g., when it is detected that the temperature inside the base 1 is lower than 150° C., the main control circuit board 4 controls the battery 8 to output a higher voltage to the conductive module 11, thereby increasing the current fed into the infrared electrothermal coating 12, improving the heating power for the aerosol-forming matrix, and reducing the waiting time for the user to take the first puff. When it is detected by the NTC temperature sensor that the temperature of the base 1 is 150° C. to 200° C., the main control circuit board 4 controls the battery 8 to output a normal voltage to the conductive module 11. When it is detected by the NTC temperature sensor that the temperature of the base 1 is 200° C. to 250° C., the main control circuit board 4 controls the battery 8 to output a lower voltage to the conductive module 11. When it is detected by the NTC temperature sensor that the temperature inside the base 1 is above 250° C., the main control circuit board 4 controls the battery 8 to stop outputting voltage to the conductive module 11.

It shall be noted that, the specification and attached drawings of the present application show the preferred embodiments of the present application. However, the present application may be implemented in many different forms, and it is not limited to the embodiments described in this specification. These embodiments are not intended to form additional limitation on the content of the present application, but are provided for a more thorough and comprehensive understanding of the disclosure of the present application. Moreover, the above technical features continue to be combined with each other to form various embodiments not listed above, all of which are regarded as within the scope described in the specification of the present application. Furthermore, those of ordinary skill in the art can make improvements or changes according to the above description, and all these improvements and changes shall fall within the scope claimed in the appended claims of the present application.

What is claimed is:

1. A heater comprising:

a base having a surface;

an infrared electrothermal coating, being disposed on the surface of the base; the infrared electrothermal coating being configured to generate infrared radiation to heat aerosol-forming matrix to generate aerosol for smoking;

a conductive module, comprising a first conductive portion and a second conductive portion arranged on the base, both the first conductive portion and the second conductive portion being electrically connected with the infrared electrothermal coating; and a flexible printed circuit board, comprising a flexible substrate, a first electrode, a second electrode, and connecting components, wherein:

the flexible substrate further comprises a covering part and an extension part;

the covering part is configured to cover at least a part of a surface of the base;

the extension part extends from the covering part away from the base;

the first electrode is disposed on the covering part of the flexible substrate and is in electrical connection with the first conductive portion;

the second electrode is disposed on the covering part of the flexible substrate and is in electrical connection with the second conductive portion; and the connecting components are disposed on the extension part of the flexible substrate and are in electrical connection with the first electrode and the second electrode, the connecting components are spaced apart from the base, and the connecting components are capable to electrically connect with external components.

2. The heater according to claim 1, wherein the covering part is formed into a shape adapted to the surface of the base.

3. The heater according to claim 2, wherein the covering part covers the infrared electrothermal coating between the first conductive portion and the second conductive portion; or the covering part covers the whole surface of the base.

4. The heater according to claim 2, wherein the flexible substrate further comprises conductive lines and the connecting components are in electrical connection with the first electrode and the second electrode through the conductive lines.

5. The heater according to claim 4, wherein a width of the covering part in a spreading direction of the flexible substrate is larger than a width of the extension part in the spreading direction.

6. The heater according to claim 2, wherein at least part of the areas of the first electrode and the first conductive portion contact with each other, and at least part of the areas of the second electrode and the second conductive portion contact with each other, in response to the flexible substrate covering the surface of the base.

7. A smoking device comprising a housing assembly and a heater arranged in the housing assembly;

wherein the heater comprises:

a base having a surface;

an infrared electrothermal coating, being disposed on the surface of the base; the infrared electrothermal coating being configured to generate infrared radiation to heat aerosol-forming matrix to generate aerosol for smoking;

a conductive module, comprising a first conductive portion and a second conductive portion arranged on the base, both the first conductive portion and the second conductive portion being electrically connected with the infrared electrothermal coating; and a flexible printed circuit board, comprising a flexible substrate, a first electrode, a second electrode, and connecting components, wherein:

the flexible substrate further comprises a covering part and an extension part;

the covering part is configured to cover at least a part of a surface of the base;

the extension part extends from the covering part away from the base;

the first electrode is disposed on the covering part of the flexible substrate and is in electrical connection with the first conductive portion;

the second electrode is disposed on the covering part of the flexible substrate and is in electrical connection with the second conductive portion; and the connecting components are disposed on the extension part of the flexible substrate and are in electrical connection with the first electrode and the second electrode, the connecting components are spaced apart from the base, and the connecting components are capable to electrically connect with external components.

8. The heater according to claim 1, wherein the connecting components comprises solder joints, welding holes, pads, via holes, or wiring terminals.

* * * * *